US008242673B2

(12) United States Patent
Nunome

(10) Patent No.: US 8,242,673 B2
(45) Date of Patent: Aug. 14, 2012

(54) SPARK PLUG

(75) Inventor: Kenji Nunome, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 402 days.

(21) Appl. No.: 12/482,021

(22) Filed: Jun. 10, 2009

(65) Prior Publication Data

US 2009/0309474 A1 Dec. 17, 2009

(30) Foreign Application Priority Data

Jun. 12, 2008 (JP) ..... 2008-154659

(51) Int. Cl.
*H01T 13/20* (2006.01)

(52) U.S. Cl. ..... 313/141; 313/118

(58) Field of Classification Search ..... 313/118–145
See application file for complete search history.

(56) References Cited

U.S. PATENT DOCUMENTS

| | | | |
|---|---|---|---|
| 6,225,752 | B1 | 5/2001 | Matsubara et al. |
| 6,566,793 | B2 | 5/2003 | Honda et al. |
| 6,856,097 | B2 | 2/2005 | Onishi |
| 6,858,975 | B1 | 2/2005 | Matsutani |
| 2001/0002096 | A1 | 5/2001 | Honda et al. |
| 2003/0168991 | A1 | 9/2003 | Onishi |
| 2008/0042539 | A1 * | 2/2008 | Walker ..... 313/135 |

FOREIGN PATENT DOCUMENTS

| | | | |
|---|---|---|---|
| JP | 11-214120 | A | 8/1999 |
| JP | 2000-277230 | A | 10/2000 |
| JP | 2001-155839 | A | 6/2001 |
| JP | 2001-243535 | A | 9/2001 |
| JP | 2001-335360 | A | 12/2001 |
| JP | 2003-331760 | A | 11/2003 |
| JP | 2005-79095 | A | 3/2005 |
| JP | 2005-203119 | A | 7/2005 |

* cited by examiner

*Primary Examiner* — Anne Hines
(74) *Attorney, Agent, or Firm* — Sughrue Mion, PLLC

(57) ABSTRACT

A spark plug has a center electrode, a ceramic insulator having an axial hole to support the center electrode therein, a metal shell holding the ceramic insulator, and a ground electrode, one end portion of which is fixedly connected with the metal shell, the other end portion of which is located apart from an outer circumferential surface of a top end portion of the center electrode for defining a spark discharge gap therebetween. The ceramic insulator is provided with recesses at an edge portion between a top end surface of the ceramic insulator and an inner circumferential surface of the axial hole. When defining first and second imaginary circles with the axis being their respective centers as circles passing through portions of the recesses whose radial distances from the axis are a maximum and a minimum respectively, a difference of diameters of the first and second imaginary circles is 0.08 mm or less.

14 Claims, 8 Drawing Sheets

SPARK PLUG

BACKGROUND OF THE INVENTION

The present invention relates to a spark plug for use in an internal combustion engine, and more particularly to a spark plug which generates a spark discharge including a surface discharge (creeping discharge) that occurs along a top end surface of a ceramic insulator, in a spark discharge gap formed between a top end portion of a ground electrode and an outer circumferential surface of a top end portion of a center electrode.

In recent years, there have been proposed and developed various spark plugs forming a spark discharge gap between a ground electrode and a center electrode and generating a surface discharge along a top end surface of a ceramic insulator. As one such spark plug, for instance, an intermittent discharge type spark plug is known, and is disclosed in Japanese Patent Provisional Publication No. 2005-203119 (hereinafter is referred to as "JP2005-203119". In the intermittent discharge type spark plug, under a normal condition, an aerial discharge, i.e. sparks through the air between one end portion of the ground electrode and a top end portion of the center electrode occur, whereas under a so-called smoldering condition in which the surface of the ceramic insulator is fouled (stained) with carbon, the spark discharge occurs in a path where the surface discharge along the top end surface of the ceramic insulator appears. Upon the occurrence of the spark discharge, the carbon adhering or deposited on the top end surface of the ceramic insulator is burned off and cleaning of the spark plug is performed, the aerial discharge then occurs again between the ground electrode and the center electrode. With regard to the ceramic insulator used in such spark plug, it is generally formed as follows. After press-molding an insulative ceramic powder (e.g. alumina) in an elastic or rubber mold together with a pin that is inserted for forming an axial hole, a compact is subjected to the cutting and the grinding processes so as to be shaped into an outside shape of the ceramic insulator. Subsequently, the pin is pulled out, and the compact is sintered then a glost firing process is carried out, the ceramic insulator is finally completed.

SUMMARY OF THE INVENTION

In the process of the ceramic insulator, however, when cutting out the compact and/or pulling out the pin, since the compact is not sintered yet, there is a case where a recess (or a depression or a concave portion) is formed at an edge portion such as a border between the top end surface and an inner circumferential surface of the axial hole of the ceramic insulator. Furthermore, if the recess is great, upon the occurrence of the surface discharge, the paths of the spark discharge tend to converge or gather in a path that passes through the recess. For this reason, when the surface of the ceramic insulator is cut or shaved off (or chipped off) by the passing spark discharge, namely, that when a so-called channeling intensively occurs at a certain point and the surface of the ceramic insulator is deeply cut, there is a possibility that a block chip will appear with the certain point being a base or starting point.

To solve the above problem, it is therefore an object of the present invention to provide a spark plug which is capable of suppressing the convergence or concentration of the channeling upon the occurrence of the surface discharge.

According to one aspect of the present invention, a spark plug generating a spark discharge including a surface discharge, comprises: a center electrode; a ceramic insulator having an axial hole that is formed in an axial center of the ceramic insulator in an axis direction to support the center electrode therein with a top end portion of the center electrode protruding from a top end surface of the ceramic insulator, the ceramic insulator provided with recesses at a first edge portion between the top end surface of the ceramic insulator and an inner circumferential surface of the axial hole; a metal shell which has a plug attachment portion provided with screw thread for installation to an internal combustion engine and holds the ceramic insulator with an outer circumference of the ceramic insulator covered with the metal shell; and a ground electrode, one end portion of which is fixedly connected with the metal shell, and the other end portion of which is located apart from an outer circumferential surface of the top end portion of the center electrode for defining a spark discharge gap therebetween, the spark discharge including the surface discharge that appears along the top end surface of the ceramic insulator occurring in the spark discharge gap, and when defining a first imaginary circle with the axis being a center as a circle that passes through a portion of the recess whose radial distance from the axis is a maximum and defining a second imaginary circle with the axis being the center as a circle that passes through a portion of the recess whose radial distance from the axis is a minimum, from among the recesses, and further expressing a difference of diameters of the first and second imaginary circles as a diameter difference X, the diameter difference X is less than or equal to 0.08 mm.

According to another aspect of the present invention, a spark plug generating a spark discharge including a surface discharge, comprises: a center electrode; a ceramic insulator having an axial hole that is formed in an axial center of the ceramic insulator in an axis direction to support the center electrode therein with a top end portion of the center electrode protruding from a top end surface of the ceramic insulator, the ceramic insulator having a chamfer surface that is formed by chamfering a first edge portion between the top end surface of the ceramic insulator and an inner circumferential surface of the axial hole and provided with recesses at a second edge portion between the chamfer surface and the top end surface; a metal shell which has a plug attachment portion provided with screw thread for installation to an internal combustion engine and holds the ceramic insulator with an outer circumference of the ceramic insulator covered with the metal shell; and a ground electrode, one end portion of which is fixedly connected with the metal shell, and the other end portion of which is located apart from an outer circumferential surface of the top end portion of the center electrode for defining a spark discharge gap therebetween, the spark discharge including the surface discharge that appears along the top end surface of the ceramic insulator occurring in the spark discharge gap, and when defining a third imaginary circle with the axis being a center as a circle that passes through a portion of the recess whose radial distance from the axis is a maximum and defining a fourth imaginary circle with the axis being the center as a circle that passes through a portion of the recess whose radial distance from the axis is a minimum, from among the recesses, and further expressing a difference of diameters of the third and fourth imaginary circles as a diameter difference Y, the diameter difference Y is less than or equal to 0.08 mm.

The other objects and features of this invention will become understood from the following description with reference to the accompanying drawings.

DETAILED DESCRIPTION OF THE INVENTION

Embodiments of a spark plug for an internal combustion engine will be explained below with reference to the drawings.

[First Embodiment]

Figure 1:
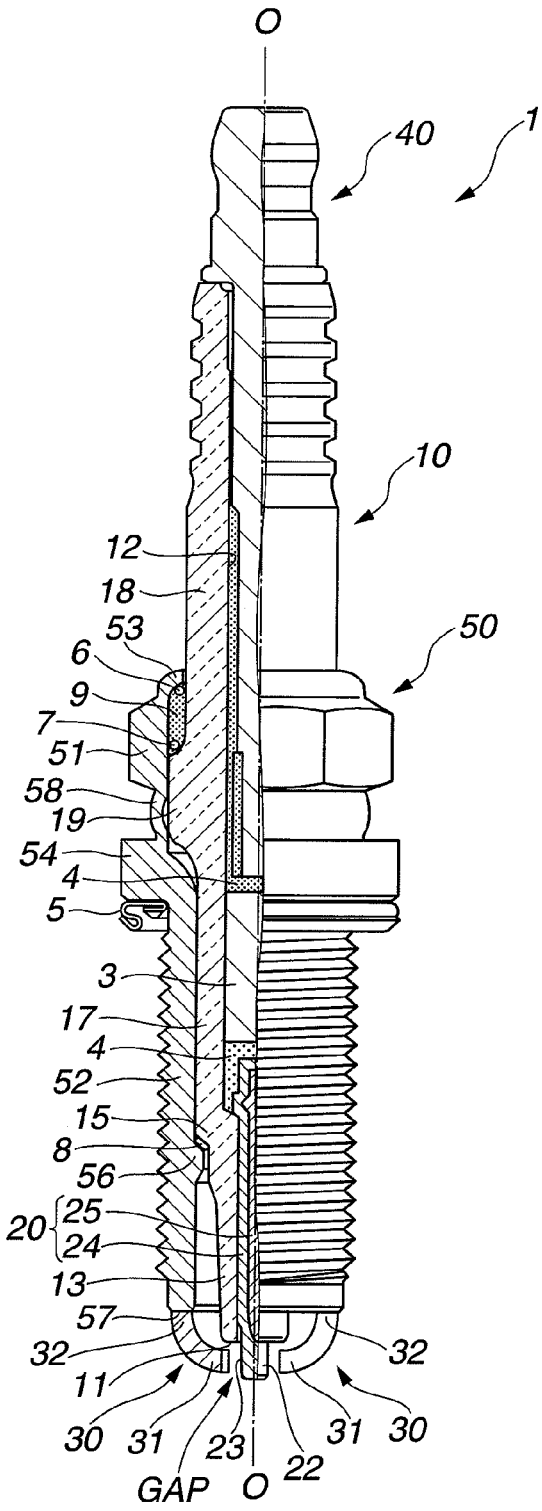
FIG. 1 is a local sectional view of a spark plug 1.
Figure 2:
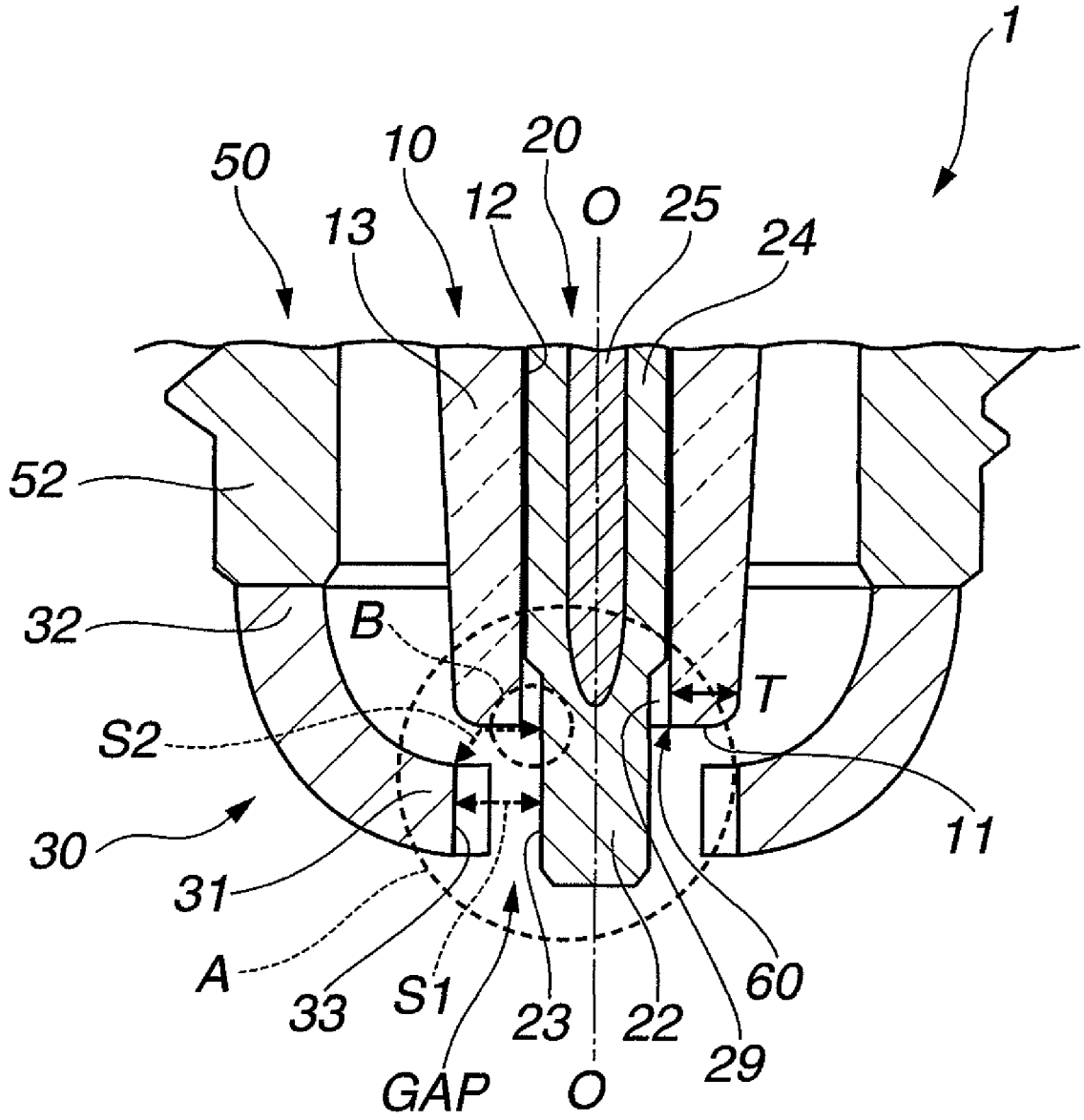
FIG. 2 is an enlarged sectional view of an area around a spark discharge gap GAP.
Figure 3:
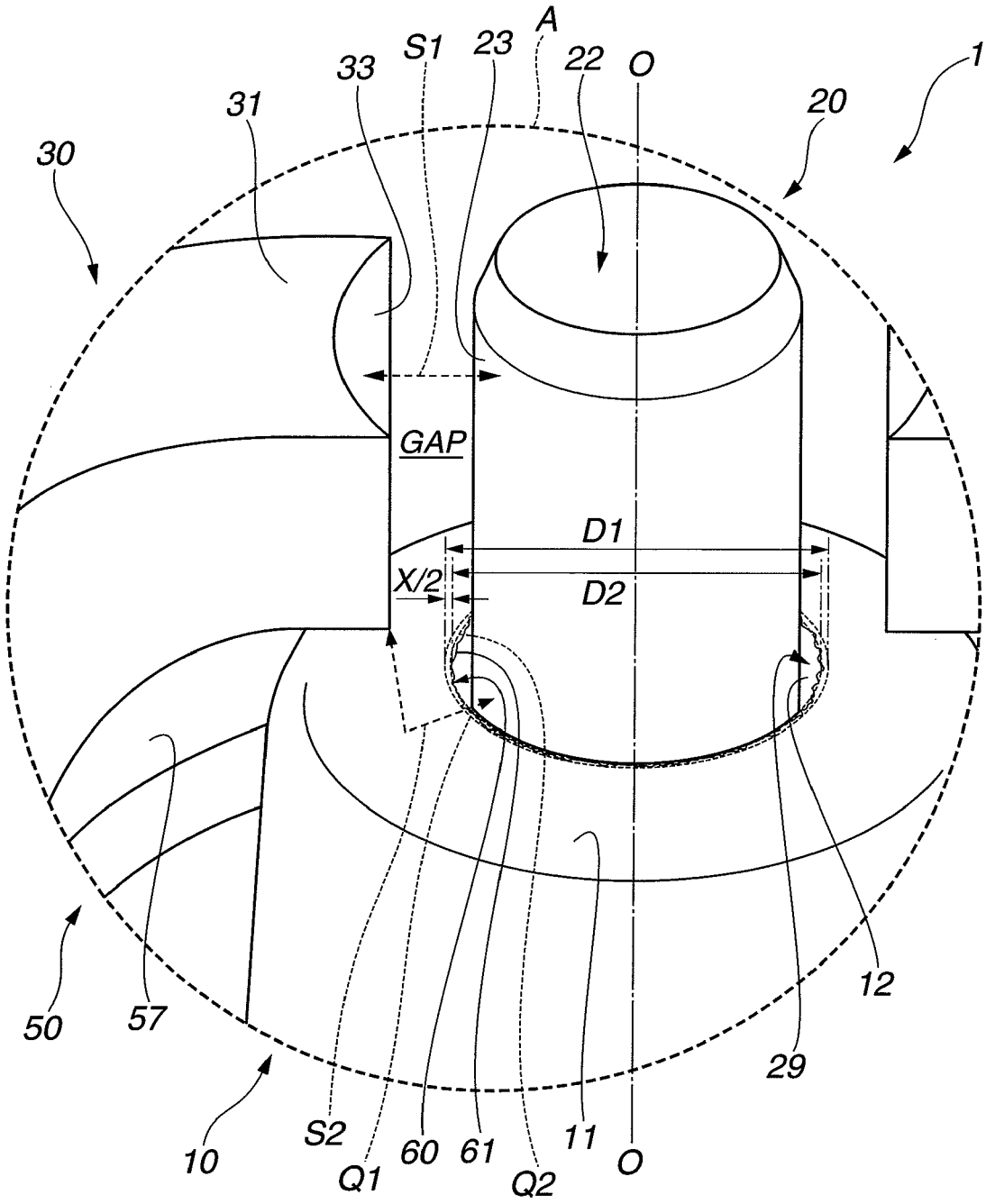
FIG. 3 is a perspective view of a dotted circle A in FIG. 2, viewed from a top end side of the spark plug 1.

A structure of a spark plug 1 will now be explained with reference to FIGS. 1 to 3. FIG. 1 is a local sectional view of the spark plug 1. FIG. 2 is an enlarged sectional view of an area around a spark discharge gap GAP. FIG. 3 is a perspective view of a dotted circle A in FIG. 2, viewed from a top end side of the spark plug 1. Here, in the following description, an axis O direction of the spark plug 1 in FIG. 1 is defined as up-and-down direction (a vertical direction), and a lower side of the spark plug 1 is termed a top end side, and an upper side of the spark plug 1 is termed a rear end side.

As shown in FIG. 1, the spark plug 1 has a structure in which a center electrode 20 is held inside an axial hole 12 of a ceramic insulator 10 at the top end side, a terminal metal jacket 40 is provided at the rear end side, and the ceramic insulator 10 is secured by being covered with a metal shell (main metal) 50. Further, a ground electrode 30 is connected with a top end surface 57 of the metal shell 50, and its other end side (namely a side of a top end portion 31 of the ground electrode 30) is curved toward a top end portion 22 of the center electrode 20. The spark discharge gap GAP is then formed between the top end portion 31 of the ground electrode 30 and an outer circumferential surface 23 of the top end portion 22 of the center electrode 20.

The ceramic insulator 10 is made of a sintered ceramic material such as sintered alumina, and is substantially formed into a cylindrical shape with the axial hole 12 formed in an axial center thereof in the axis O direction. A brim portion 19 having a largest outside diameter is formed substantially in the middle in the axis O direction, and also a rear end side body 18 is formed on the rear end side of the brim portion 19 (i.e. on the upper side in FIG. 1). Further, a top end side body 17 whose outside diameter is smaller than that of the rear end side body 18 is formed on the top end side of the brim portion 19 (i.e. on the lower side in FIG. 1). Moreover, a leg portion 13 whose outside diameter is smaller than that of the top end side body 17 is formed on the top end side of the top end side body 17. This leg portion 13 tapers to its top, and is exposed to a combustion chamber when the spark plug 1 is installed in an engine cylinder head (not shown) of the internal combustion engine. Between the leg portion 13 and the top end side body 17, a stepped portion 15 is formed.

Regarding the center electrode 20, it is a rod-shaped electrode, and has a body material 24 made of Ni or Ni-based alloy such as Inconel 600 or 601 (trademark) or made of a high-Ni containing alloy having a higher Ni content than these Ni and Inconel 600 or 601, and a core material 25 which is embedded in the body material 24 and made of Cu or Cu-based alloy having a higher thermal conductivity than that of the body material 24. As shown in FIG. 2, the center electrode 20 is held on the top end side in the axial hole 12 of the ceramic insulator 10, and its top end portion 22 has a slightly small diameter. This top end portion 22 protrudes toward the top end side from a top end surface 11 of the ceramic insulator 10. As can be seen in FIG. 2, a part of the small diameter top end portion 22 is positioned or situated inside the axial hole 12 of the ceramic insulator 10, thereby defining a clearance between the part of the top end portion 22 and an inner circumferential surface of the axial hole 12. This clearance is termed a thermo-space 29, and by providing this thermo-space 29, thermal conduction to a side of the center electrode 20 around the top end surface 11 of the ceramic insulator 10 can be suppressed. The top end surface 11 is thus kept at a slightly higher temperature than its surroundings, and even when the carbon etc. adheres or is deposited on the top end surface 11 under the smoldering condition, the top end surface 11 is easily cleaned. The fouling (carbon stain) of the top end surface 11 is consequently reduced.

Returning to FIG. 1, the center electrode 20 is electrically connected to the terminal metal jacket 40 provided on the rear end side (i.e. on the upper side in FIG. 1) through a conductive sealing member 4 that extends along the axis O direction in the axial hole 12 and a ceramic resistance 3. When using the spark plug 1, a high-tension cable (not shown) is connected to the terminal metal jacket 40 via a plug cap (not shown), and a high voltage is applied.

Next, with respect to the metal shell 50, it is a substantially cylindrical shell for fixing the spark plug 1 to the engine cylinder head of the internal combustion engine. The metal shell 50 covers or surrounds a section from part of the rear end side body 18 to the leg portion 13 of the ceramic insulator 10, then holds the ceramic insulator 10 therein. The metal shell 50 is made of low-carbon steel, and provided with a tool engagement portion 51 to which a spark plug wrench (not shown) is fitted and a plug attachment portion 52 having screw thread to be screwed into a plug hole (not shown) of the engine cylinder head. The spark plug 1 in the present embodiment is a small-type plug which is generally called a long-reach type and has a long reach screw thread. More specifically, the reach of screw thread, namely a length in the axis O direction between two screw thread formation starting positions (i.e. both end points of the screw thread) provided on the plug attachment portion 52, is 25 mm or more. Further, the metal shell 50 has a small diameter, namely that a nominal diameter of the plug attachment portion 52 is M12 or less (for example, M10 or less).

Furthermore, a brim-shaped seal portion 54 is provided between the tool engagement portion 51 and the s plug attachment portion 52 of the metal shell 50. Also a ring-shaped gasket 5, formed by bending a plate material, is inserted between the plug attachment portion 52 and the seal portion 54. The gasket 5 is pressed and crushed then deformed between the seal portion 54 and an opening edge of the plug hole upon the installation of the spark plug 1 to the plug hole of the engine cylinder head, then serves to seal the opening edge for preventing engine gas leakage through the plug hole.

The metal shell 50 is also provided with a thin swage portion 53 on the rear end side of the tool engagement portion 51. In addition, a thin buckling portion 58 is provided between the seal portion 54 and the tool engagement portion 51. Between an inner circumferential surface of the metal shell 50 from the tool engagement portion 51 to the swage portion 53 and an outer circumferential surface of the rear end side body 18 of the ceramic insulator 10, annular ring members 6 and 7 are interposed. A talc powder (talc) 9 is filled between these annular ring members 6 and 7. The swage portion 53 is bent inward by swaging, the ceramic insulator 10 is then pressed toward the top end side inside the metal shell 50 through the annular ring members 6, 7 and the talc 9. The metal shell 50 and the ceramic insulator 10 are therefore fixedly connected with each other, with the stepped portion 15 of the ceramic insulator 10 supported on a stepped part 56 that is formed at the plug attachment portion 52 on the inner circumferential surface of the metal shell 50 via a ring-shaped plate packing 8. With this hermetically and tightly sealed contact between the metal shell 50 and the ceramic insulator 10 via the plate packing 8, the engine gas leakage can be prevented. Here, the buckling portion 58 is bent and deformed outwards by an application of a compression force during the swaging so as to increase a compression length of the talc 9 in the axis O direction and improve the gas-tightness of the metal shell 50.

As for the ground electrode 30, it is a rod-shaped electrode having a rectangular cross section. The ground electrode 30 is made of Ni or Ni-based alloy such as Inconel 600 or 601 (trademark) or made of a high-Ni containing alloy having a higher Ni content than these Ni and Inconel 600 or 601, same as the center electrode 20. In the first embodiment, two ground electrodes 30 are provided, and the respective one end portions (base end portions 32 of the ground electrodes 30) are arranged symmetrically with respect to the axis O and are fixedly connected with the top end surface 57 of the metal shell 50. As can be seen in the drawings, these two ground electrodes 30 extend along the axis O direction toward the top end side, and each other end portion (i.e. the each top end portion 31) of the ground electrodes 30 is curved toward the top end portion 22 of the center electrode 20. More specifically, the ground electrode 30 is curved so that a top end surface 33 of the top end portion 31 faces the outer circumferential surface 23 of the top end portion 22 of the center electrode 20. The spark discharge gap GAP is then formed between this top end portion 31 of the ground electrodes 30 and the outer circumferential surface 23 of the top end portion 22 of the center electrode 20. As shown in FIG. 3, the top end surface 33 of the top end portion 31 of the ground electrodes 30 has an inwardly curved surface, in other words, the top end surface 33 is curved inward along a shape of the outer circumferential surface 23 of the top end portion 22 of the center electrode 20 so that there is no difference in size (length) of the spark discharge gap GAP depending on a position of the top end surface 33.

In the spark plug 1 having the above-described structure in the first embodiment, as illustrated in FIGS. 2 and 3, the spark discharge gap GAP is provided between the top end portion 31 of the ground electrodes 30 and the outer circumferential surface 23 of the top end portion 22 of the center electrode 20, as explained above. Under the normal condition, as indicated by an arrow S1 in the drawings, an aerial discharge, i.e. sparks through the air in the spark discharge gap GAP occur. On the other hand, under the smoldering condition etc. of the spark plug 1, as indicated by an arrow S2 in the drawings, the surface discharge (creeping discharge) that appears on and along the top end surface 11 of the ceramic insulator 10 occurs, and the cleaning of the spark plug 1 is performed by burning off the carbon adhering or deposited on the top end surface 11.

Here, upon the occurrence of the surface discharge, although the sparks appear and pass through an edge portion (a first edge portion) 60 between the top end surface 11 and the inner circumferential surface of the axial hole 12 of the ceramic insulator 10, in the first embodiment, a microscopic or miniscule recess (or depression or concave portion) 61 is formed at this edge portion 60. This microscopic recess 61 is provided in the manufacturing process of the ceramic insulator 10. More specifically, the microscopic recess 61 is formed in the following manner. After press-molding a ceramic powder (e.g. alumina) in an elastic or rubber mold in which a pin to provide the axial hole 12 is disposed, a compact is subjected to the cutting and the grinding processes so as to be shaped into an outside shape of the ceramic insulator 10. Subsequently, the pin is pulled out, and the compact is sintered then a glost firing process is carried out, the ceramic insulator 10 is finally completed.

In this manufacturing process of the ceramic insulator 10, for example, after pulling out the pin to form the axial hole 12, a recess-forming pin having microscopic projections and depressions or asperities to provide the microscopic recess is inserted into the compact from a top end side, the microscopic recess is thus provided. However, the way of forming the microscopic recess is not limited to this. As the pin to form the axial hole 12, a longitudinally dividable pin that is divided into two pins; a top end side pin for forming a section corresponding to the leg portion 13 and a rear end side pin for forming a section of the rear end side of the leg portion 13, is prepared. And after press-molding the ceramic powder such as the alumina, the rear end side and the top end side pins are pulled out in the rear end and top end directions respectively. Here, for instance, by providing minute or fine vibration when pulling out the top end side pin, the microscopic recess could be formed in an area of the edge portion 60 of the ceramic insulator 10.

The first embodiment provides a proper size or definition of size of this recess 61, and the recess 61 is prevented from becoming a base or starting point of the concentration of the channeling.

Figure 4:
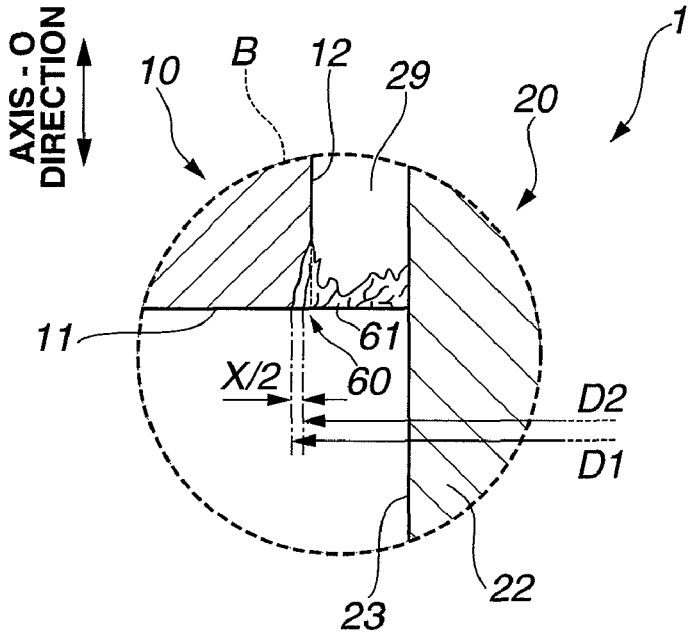
FIG. 4 is an enlarged sectional view of a dotted circle B in FIG. 2.
Figure 5:
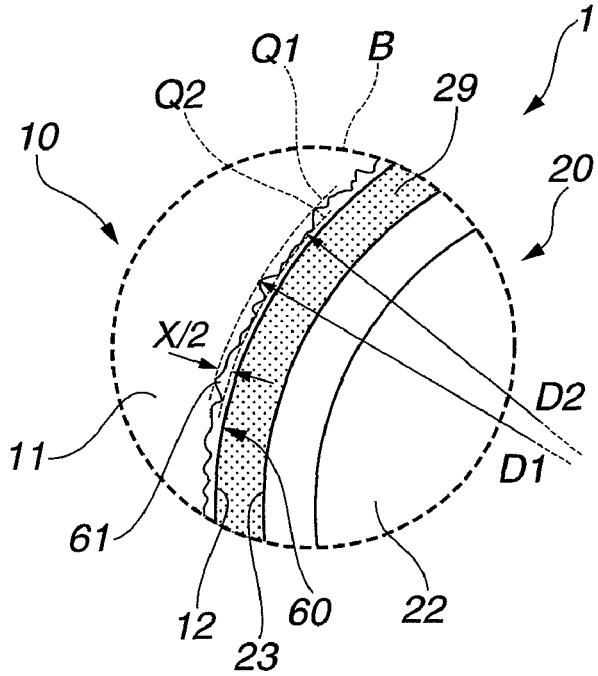
FIG. 5 is a perspective view of the dotted circle B in FIG. 2, viewed from a front side of the spark plug 1 along an axis O.

In the following, definition provided to the ceramic insulator 10 will be explained with reference to FIGS. 3 to 5. FIG. 4 is an enlarged sectional view of a dotted circle B in FIG. 2. FIG. 5 is a perspective view of the dotted circle B in FIG. 2, viewed from a front side of the spark plug 1 along the axis O.

As illustrated in FIGS. 3 to 5, a first imaginary circle Q1 with the axis O being the center is defined as a circle that passes through a portion of the recess 61 whose radial distance from the axis O is a maximum, from among the recesses 61 formed in the edge portion 60 between the top end surface 11 and the inner circumferential surface of the axial hole 12 of the ceramic insulator 10. Likewise, a second imaginary circle Q2 with the axis O being the center is defined as a circle that passes through a portion of the recess 61 whose radial distance from the axis O is a minimum, from among the recesses 61. However, regarding the maximum portion and minimum portion of the recess 61 among the recesses 61, an area whose depth from the top end surface 11 of the ceramic insulator 10 in the axis O direction is up to 0.1 mm is an object as the recesses 61. Then when representing the respective diameters of the first and second imaginary circles Q1, Q2 as D1 and D2, a difference X of the diameters D1 and D2 of the first and second imaginary circles Q1, Q2 is expressed as (D1−D2). The first embodiment determines that this diameter difference X is less than or equal to 0.08 mm.

If there is a portion having the diameter difference X that is greater than 0.08 mm in the recess 61, paths of the sparks emitted on and along the top end surface 11 of the ceramic insulator 10 and flying to (or thrown off to) the outer circumferential surface 23 of the center electrode 20 are apt to converge or gather in a path passing through the portion having the diameter difference X that is greater than 0.08 mm, upon the occurrence of the surface discharge. Because of this, there is a risk that the surface of the ceramic insulator 10 on this path will be cut or shaved off (or chipped off) due to the spark discharge, namely that a so-called channeling will intensively occur at a certain point. Furthermore, if the certain point on the surface of the ceramic insulator 10 is deeply cut by the concentration of this channeling, there is a possibility that a block chip will appear along a grain boundary of crystal structure of the ceramic insulator 10 with the certain point being a base or starting point. However, when setting the diameter difference X to 0.08 mm or less, it is possible to suppress the convergence of the path of the spark on the certain point upon the occurrence of the surface discharge, and an occurrence of the concentration of the channeling can be suppressed.

In addition to the above definition, the first embodiment determines that the diameter difference X is greater than or equal to 0.004 mm. If there is a portion having the diameter difference X that is less than 0.004 mm in the recess 61, the size of the recess 61 in this portion becomes extremely small, and the edge of the edge portion 60 remains as it is. Heat tends to be accumulated in such edge. When a temperature of such edge becomes locally high, thermal etching occurs at this high-temperature area. This might cause dissolution of the grain boundary of crystal structure of the ceramic insulator 10, and result in the concentration of the channeling with this dissolved area being the starting point. Hence, it is desirable that the diameter difference X should be 0.004 mm or greater.

[Second Embodiment]

Figure 6:
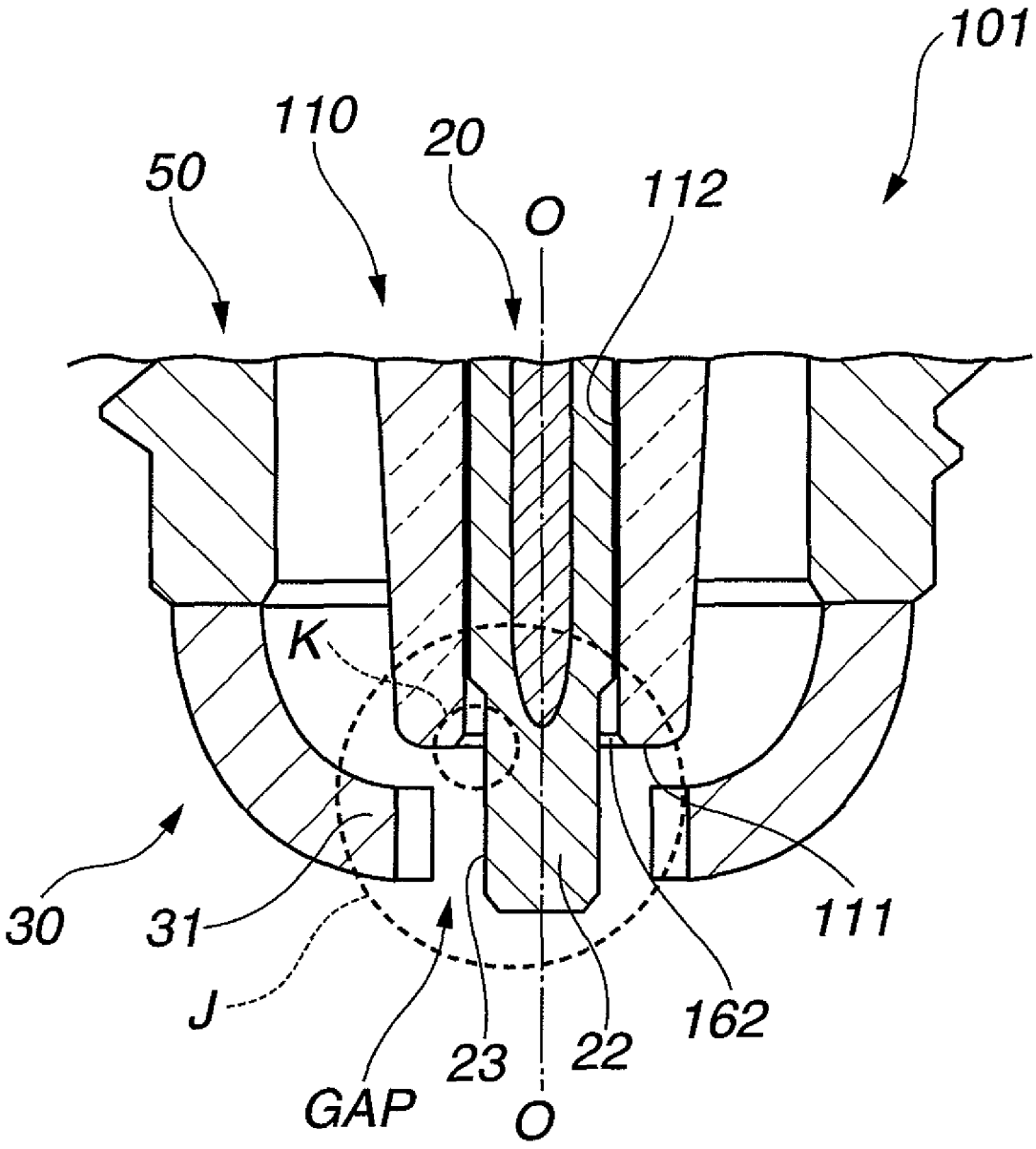
FIG. 6 is an enlarged sectional view of an area around a spark discharge gap GAP of a spark plug 101, according to a second embodiment.
Figure 7:
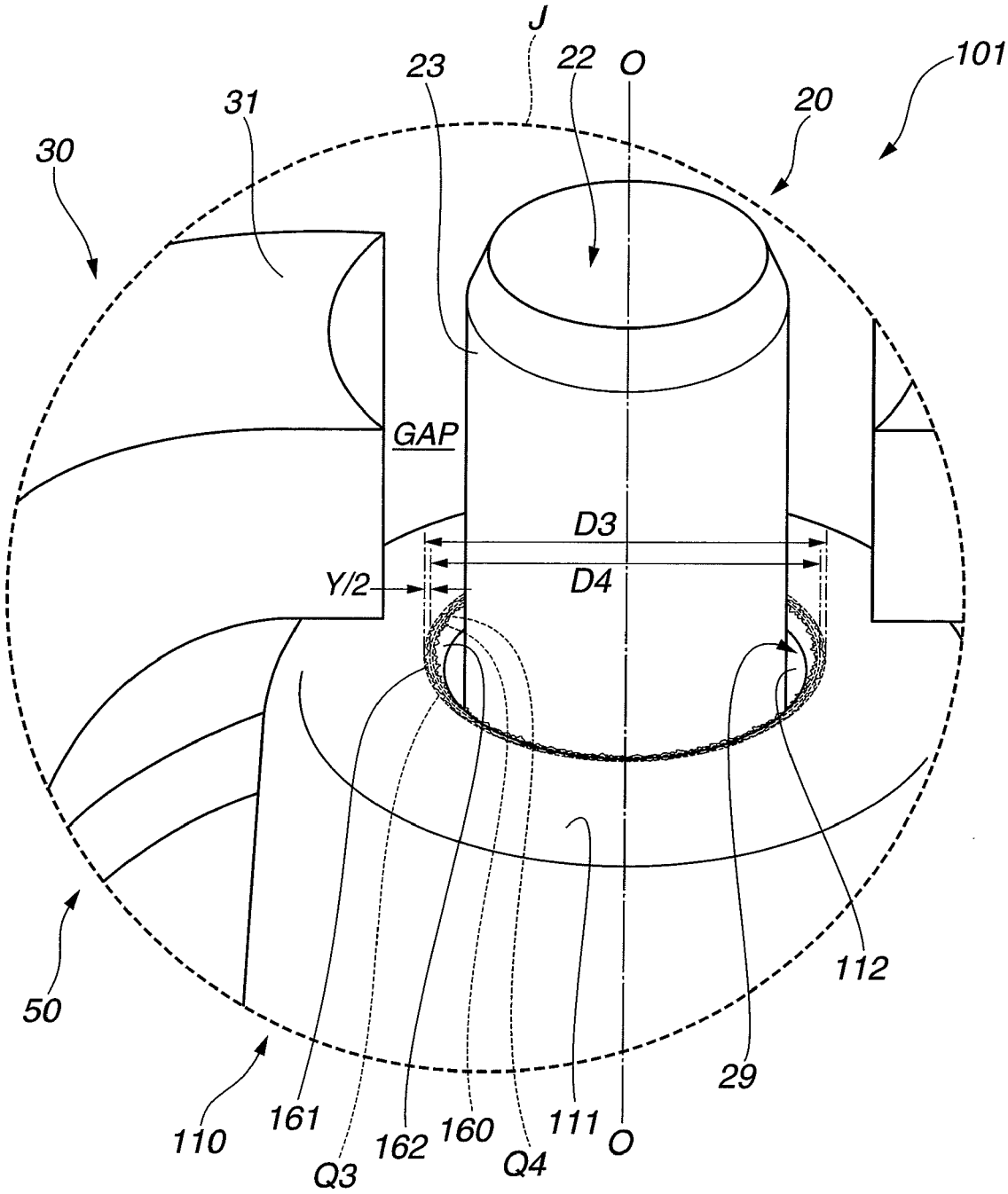
FIG. 7 is a perspective view of a dotted circle J in FIG. 6, viewed from a top end side of the spark plug 101.
Figure 8:
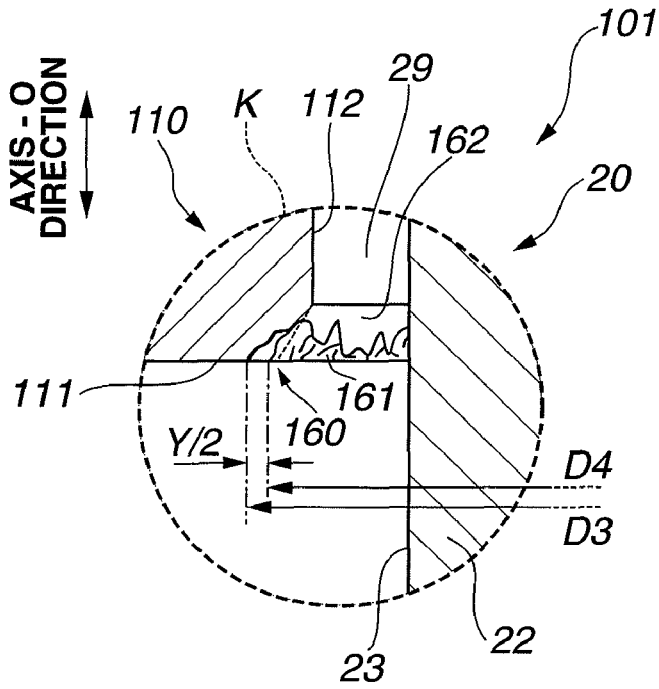
FIG. 8 is an enlarged sectional view of a dotted circle K in FIG. 6.
Figure 9:
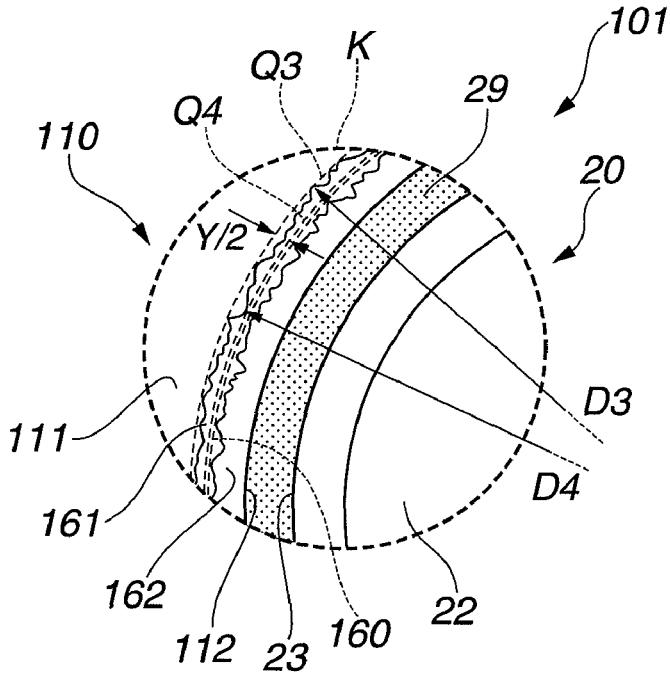
FIG. 9 is a perspective view of the dotted circle K in FIG. 6, viewed from a front side of the spark plug 101 along an axis O.

Next, a second embodiment of the spark plug will be explained with reference to FIGS. 6 to 9. FIG. 6 is an enlarged sectional view of an area around a spark discharge gap GAP of a spark plug 101, according to the second embodiment. FIG. 7 is a perspective view of a dotted circle J in FIG. 6, viewed from a top end side of the spark plug 101. FIG. 8 is an enlarged sectional view of a dotted circle K in FIG. 6. FIG. 9 is a perspective view of the dotted circle K in FIG. 6, viewed from a front side of the spark plug 101 along an axis O.

As shown in FIG. 6, the spark plug 101 in the second embodiment has a chamfer surface 162 that is formed by chamfering an edge portion (a first edge portion) between a top end surface 111 and an inner circumferential surface of an axial hole 112 of a ceramic insulator 110. Furthermore, as illustrated in FIG. 7, a microscopic recess 161, same as the first embodiment, is provided at an edge portion (a second edge portion) 160 between the chamfer surface 162 and the top end surface 111. Other portions and structure of the spark plug 101 are the same as the spark plug 1 of the first embodiment, thus their explanations are omitted here.

In the spark plug 101 having the above-described structure, the second embodiment also focuses attention on the recess 161, and by providing definition of the size of the recess 161, the recess 161 is prevented from becoming the starting point of the concentration of the channeling.

As illustrated in FIGS. 7 to 9, a third imaginary circle Q3 with the axis O being the center is defined as a circle that passes through a portion of the recess 161 whose radial distance from the axis O is a maximum, from among the recesses 161 formed in the edge portion 160 between the top end surface 111 and the chamfer surface 162 of the ceramic insulator 110. Likewise, a fourth imaginary circle Q4 with the axis O being the center is defined as a circle that passes through a portion of the recess 161 whose radial distance from the axis O is a minimum, from among the recesses 161. Then when representing the respective diameters of the third and fourth imaginary circles Q3, Q4 as D3 and D4, a difference Y of the diameters D3 and D4 of the third and fourth imaginary circles Q3, Q4 is expressed as (D3−D4). As same as the first embodiment, the second embodiment determines that the diameter difference Y is 0.004~0.08 mm.

If there is a portion having the diameter difference Y that is greater than 0.08 mm in the recess 161, paths of the spark discharge are apt to converge upon the occurrence of the surface discharge. Because of this, there is a risk that the surface of the ceramic insulator 110 on this path will be cut or shaved off (or chipped off) due to the concentration of the channeling. Furthermore, if a certain point on the surface of the ceramic insulator 110 is deeply cut by this concentration of the channeling, there is a possibility that a block chip will appear along a grain boundary of crystal structure of the ceramic insulator 110 with the certain point being a base or starting point. Moreover, If there is a portion having the diameter difference Y that is less than 0.004 mm in the recess 161, local thermal etching tends to occur at this portion. This might cause dissolution of the grain boundary of crystal structure of the ceramic insulator 110, and result in the concentration of the channeling with this dissolved area being the starting point.

As explained above, in the spark plug 1, 101 in the first and second embodiments, the definitions concerning the sizes of the recesses 61, 161 formed in the edge portions 60, 160 of the ceramic insulators 10, 110 are provided. In addition, in order to obtain a higher effect by the prevention of the cutting caused by the channeling, the first and second embodiments further provide definitions concerning materials and sizes of the ceramic insulators 10, 110. More specifically, the first and second embodiments determine that the each ceramic insulator 10, 110 contains 0.02~0.30 mass % in total of at least one or more oxides selected from $TiO_2$, $Fe_2O_3$, $ZrO_2$ as the material of the ceramic insulators 10, 110. Since these oxides have conductivity, when mixing a small amount of these oxides as the material of the ceramic insulators 10, 110 into the each ceramic insulator 10, 110, a resistance of surface of the ceramic insulator 10, 110 decreases, and it is conceivable that even if the surface discharge appearing on the surface of the ceramic insulators 10, 110 occurs, this oxide-mixed ceramic insulator has an effect of reducing damage to the ceramic insulators 10, 110 resulting from the sparks. Accordingly, by mixing the small amount of the oxides into the ceramic insulator, the cutting of the surface of the ceramic insulator 10, 110, caused by the spark discharge, can be suppressed, and the occurrence of the concentration of the channeling can be suppressed.

In order to effectively suppress the cutting of the surface of the ceramic insulator 10, 110 due to the spark discharge, according to an after-mentioned experiment 2, it is desirable that the ceramic insulator should contain 0.02 mass % or more in total of at least one or more oxides selected from $TiO_2$, $Fe_2O_3$, $ZrO_2$. However, this means blending the conductive material with the ceramic insulators 10, 110, thus brings about a slight decrease or deterioration in a withstand voltage performance of the ceramic insulators 10, 110. According to the after-mentioned experiment 2, when the ceramic insulator contains 0.30 mass % or less in total content of at least one or more oxides selected from $TiO_2$, $Fe_2O_3$, $ZrO_2$, an adequate withstand voltage performance required of the ceramic insulators 10, 110 can be secured.

Furthermore, in order to obtain a more adequate withstand voltage performance in these ceramic insulators 10, 110 containing the conductive oxides, it is desirable that a thickness T of the top end portion of the ceramic insulator 10, 110 should be 0.8 mm or greater. Here, this thickness T is a thickness referred to a minimum thickness in the radial direction within a range of 0.8 mm 2 mm in the axis O direction with reference to the top end surface 11, 111 of the ceramic insulator 10, 110. If the thickness T is less than 0.8 mm, no adequate withstand voltage performance is obtained, and there is a risk that penetration fracture (or insulation penetration) will occur to the ceramic insulator 10, 110.

Moreover, the first and second embodiments determine that, as a material of the ceramic insulators 10, 110, a content of $B_2O_3$ is 0.14 mass % or less. It is known that when the ceramic insulator 10, 110 contains $B_2O_3$, a melting point of the ceramic insulator 10, 110 is lowered. If the melting point lowers, this results in dissolution (consumption or wear) of the grain boundary of crystal structure of the ceramic insulator 10, 110. Less content of $B_2O_3$ is therefore preferable. However, according to an after-mentioned experiment 3, it was found that when the content of $B_2O_3$ is 0.14 mass % or less, an influence of the cutting of the ceramic insulator 10, 110, resulting from the channeling and/or the block chip along the grain boundary of crystal structure of the ceramic insulator 10, 110, is sufficiently small even when blending $B_2O_3$ with the ceramic insulator 10, 110.

Further, as previously mentioned above, the spark plug 1, 101 of the first and second embodiments is the small-type plug generally called the long-reach type and having the long reach screw thread. More specifically, the reach of screw thread is 25 mm or more, and the metal shell 50 has the small diameter, namely that the nominal diameter of the plug attachment portion 52 is M12 or less (for example, M10 or less).

The longer the reach of the screw thread, the longer an overall length of the metal shell 50 is, thereby making a length of the ceramic insulator 10, 110 where the metal shell 50 holds longer. Here, there is a case where the ceramic insulator 10, 110 is formed eccentrically during manufacturing process due to unevenness of a press-density of the compact press-molded from the ceramic powder and an undesirable curve of a cutting pin upon the cutting process after the press-molding. When the compact of the eccentrically-formed ceramic insulator 10, 110 is sintered, a slight curvature might occur in the ceramic insulator 10, 110. Further, the longer an overall length of the ceramic insulator 10, 110, the greater a relative size of the curvature is. Accordingly, in the case where the reach of screw thread is long, there is a risk that the top end portion of the ceramic insulator 10, 110 will sift or deviate from the axis O of the spark plug 1, 101. In the spark plug 1, 101 provided with such ceramic insulator 10, 110 having the curvature, there is a case where the direction of the surface discharge (creeping discharge) appearing between the one ground electrode 30 of two ground electrodes 30 and the center electrode 20 agrees with a direction of the curvature (curve) of the ceramic insulator 10, 110 in the first and second embodiments. In this case, the spark discharge intensively occurs only at that ground electrode 30, and this could cause the occurrence of the channeling. Consequently, as described above, the setting of the determinations of the diameter difference X, the diameter difference Y, the thickness T and the material contained in the ceramic insulator etc. provides the effects of suppressing the occurrence of the channeling even if the spark discharge concentrates. When using the metal shell 50 whose screw thread reach is 25 mm or more and applied to the spark plug 1, 101 having the ceramic insulator 10, 110 whose overall length tends to be long, a high effect can be gained.

Furthermore, when designing the small diameter spark plug 1, 101 in which the nominal diameter of the plug attachment portion 52 of the metal shell 50 is M10 so as to be able to increase degree of freedom of engine design, a thickness in the radial direction, of the top end portion of the ceramic insulator 10, 110 necessarily becomes thin by limitation of outside and inside diameters. The thinner the thickness of the ceramic insulator 10, 110, the more greatly a slight difference of the thickness affects maintenance of insulation performance. Thus, in the case where the block chip appears in the top end portion of the ceramic insulator 10, 110, the smaller the diameter of the spark plug, the greater the influence to the maintenance of insulation performance is. Consequently, as described above, the setting of the determinations of the diameter difference X, the diameter difference Y, the thickness T and the material contained in the ceramic insulator etc. provides the effects of securing the insulation performance of the ceramic insulator 10, 110. And when using the spark plug 1, 101 in which the nominal diameter of the plug attachment portion 52 is M12 or less, a high effect can be gained. Further, when the nominal diameter of the plug attachment portion 52 is M10 or less in the spark plug 1, 101 of the first and second embodiments, an even higher effect can be gained.

Needless to say, the present invention could be modified. In the first and second embodiments, as the spark plug 1, 101, a so-called intermittent discharge type spark plug; the top end portion 31 of the ground electrode 30 is curved toward the outer circumferential surface 23 of the center electrode 20, is employed. The intermittent discharge type spark plug is a spark plug (a so-called semi-creeping type spark plug) in which while the aerial discharge occurs between the ground electrode 30 and the center electrode 20 under the normal condition, the surface discharge occurs on and along the top end surface 11, 111 of the ceramic insulator 10, 110 under the smoldering condition.

Figure 10:
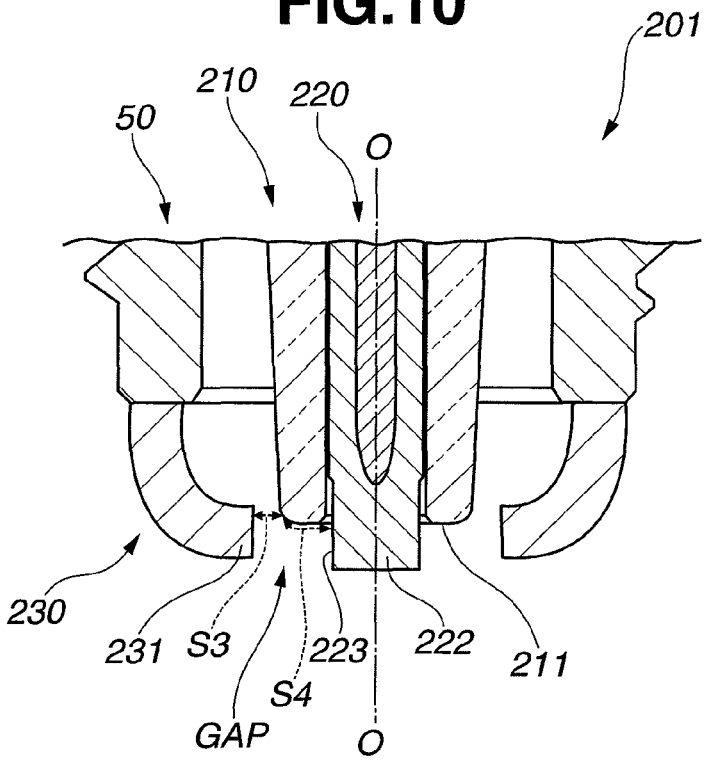
FIG. 10 is an enlarged sectional view of an area around a spark discharge gap GAP of a spark plug 201, as a modification.

Further, for instance, the present invention could be applied to a so-called creeping discharge or surface discharge type spark plug, such as a spark plug 201 shown in FIG. 10, in which both of the aerial discharge indicated by an arrow S3 and the surface discharge (creeping discharge) indicated by an arrow S4 occur in a spark discharge gap GAP between a top end portion 231 of a ground electrode 230 and an outer circumferential surface 223 of a top end portion 222 of a center electrode 220 all the time. As can be seen in FIG. 10, the spark plug 201 has a structure in which a top end surface 211 of a ceramic insulator 210 is situated or interposed between the top end portion 231 of the ground electrode 230 and the outer circumferential surface 223 of the center electrode 220, and further a size or gap distance of the spark discharge gap GAP is so adjusted or fine-tuned as to be able to produce the aerial discharge indicated by the arrow S3 and the surface discharge indicated by the arrow S4 between the top end portion 231 of the ground electrode 230 and the outer circumferential surface 223 of the center electrode 220 with a lower voltage than a voltage that directly produces the aerial discharge.

Figure 11:
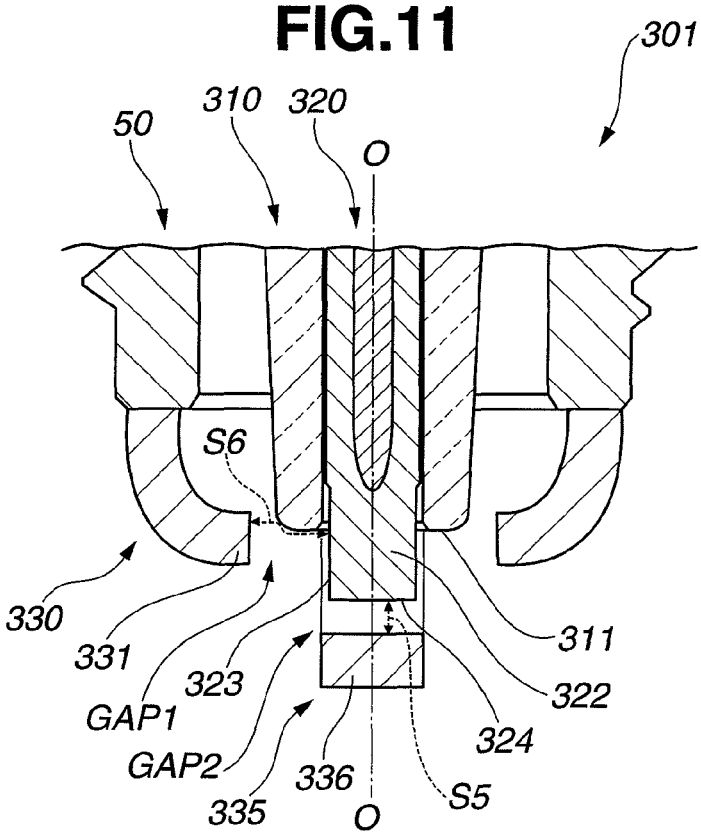
FIG. 11 is an enlarged sectional view of an area around spark discharge gaps GAP 1 and GAP 2 of a spark plug 301, as a modification.

Moreover, the present invention could be applied to a so-called hybrid type spark plug, such as a spark plug 301, as shown in FIG. 11, having two kinds of ground electrode; a main ground electrode 335 whose top end portion 336 extends to and is positioned on the top end side in the axis O direction, of a top end surface 324 of a top end portion 322 of a center electrode 320, and a sub-ground electrode 330 provided same as the ground electrodes 30 of the above-described embodiments. More specifically, as can be seen in FIG. 11, the spark plug 301 has a structure in which sizes or gap distances of spark discharge gaps GAP1, GAP2 are so adjusted or fine-tuned as to be able to produce the aerial discharge, as indicated by an arrow S5, between the top end surface 324 of the top end portion 322 of the center electrode 320 and the top end portion 336 of the main ground electrode 335 under the normal condition, and produce both the surface discharge and the aerial discharge, as indicated by an arrow S6, between a top end portion 331 of the sub-ground electrode 330 and an outer circumferential surface 323 of the top end portion 322 of the center electrode 320 through a top end surface 311 of a ceramic insulator 310 under the smoldering condition.

Although the present invention might be applied to a typical or normal spark plug, when used for the spark plugs such as the spark plug 1, 101, 201 and 301, designed based on the premise that the surface discharge occurs, the cutting of the ceramic insulator, caused by the channeling, can be effectively suppressed, and this provides long operating life.

Next, evaluation experiments will be explained below. In order to verify the effects by the definitions such as size of the recess 61, 161 formed at the edge portion 60, 160 of the ceramic insulator 10, 110, material and thickness T of the ceramic insulator 10, 110, the evaluation experiments were carried out.

EXPERIMENT 1

Evaluation concerning the size of the recess formed at the edge portion of the ceramic insulator was carried out. In the experiment, first, a plurality of samples of the ceramic insulator used for one-polar (one ground electrode) semi-creeping spark plug were made. Regarding the material of the ceramic insulator, it was the same composition as an after-mentioned sample 29 in the experiment 2 (see Table 2). Further, the ceramic insulator was made so that the thickness T of the top end portion of ceramic insulator was 0.92 mm.

Next, a three-dimensional shape of the recess formed in the each sample was determined through a CT scan, and the first imaginary circle Q1 passing through the portion of the recess whose radial distance is the maximum and the second imaginary circle Q2 passing through the portion of the recess whose radial distance is the minimum were defined for the each sample. Here, when setting the maximum portion and minimum portion of the recess, the area whose depth from the top end surface of the ceramic insulator in the axis O direction is up to 0.1 mm was an object as the recesses, from among the recesses. Then, the diameters D1 and D2 of the first and second imaginary circles Q1, Q2 were determined for the each sample, and the diameter difference X was calculated. Moreover, ten types of sample, each of which has a different diameter difference X within a range from 0.001~0.16 mm, were extracted or selected from the plurality of samples, and numbered from 1 to 10 in order of the size of the diameter difference X.

After completing the one-polar semi-creeping spark plugs using these prepared ceramic insulator samples 1~10, the each spark plug was installed in a test engine (a piston displacement 0.66 L, an inline 3 cylinder engine, DOHC, 4 valves, a direct-injection turbocharger engine (boost pressure 200 mmHG (≈26.7 MPa/3600 rpm)). In a combustion chamber, the top end surface of the ceramic insulator protrudes from an inner wall surface of the combustion chamber by 9 mm. Then a 12-hour drive test was carried out under a condition in which air-fuel mixture of A/F 14.4 is supplied in a fixed-2$^{nd}$ speed at 40 km/h. After the drive test, a three-dimensional shape of a portion on the top end surface of the ceramic insulator, which was cut by the channeling, was determined for the each sample through the CT scan, and a depth of a most deeply cut portion was measured for the each sample. A result of this evaluation experiment is shown in Table 1.

TABLE 1

| Sample | Diameter Difference X of Maximum and Minimum Recesses [mm] | Deepest Channeling Depth [mm] |
|---|---|---|
| 1 | 0.001 | 0.26 |
| 2 | 0.004 | 0.21 |
| 3 | 0.009 | 0.20 |
| 4 | 0.01 | 0.20 |
| 5 | 0.03 | 0.21 |
| 6 | 0.04 | 0.22 |
| 7 | 0.06 | 0.24 |
| 8 | 0.08 | 0.26 |
| 9 | 0.12 | 0.32 |
| 10 | 0.16 | 0.34 |

As shown in Table 1, it was verified that, in the samples 4~10 of the diameter difference X 0.01 or greater, as the diameter difference X becomes greater, the depth of the most deeply cut portion due to the channeling becomes deeper. Further, in the samples 9, 10 having over 0.08 mm diameter difference X, the depth of the portion cut by the channeling exceeded 0.32 mm. It is empirically known that when the depth of the portion cut by the channeling is beyond 0.3 mm, the block chip tends to appear. Thus, to prevent such problem, it was found that the diameter difference X should be 0.08 mm or less.

On the other hand, in the samples 1~3, each diameter difference X of which is less than 0.01 mm, it was verified that as the diameter difference X becomes smaller, the depth of the most deeply cut portion due to the channeling becomes deeper. This is due to the following mechanism. Because the size of the recess is small, heat is accumulated at the edge portion between the top end surface of the ceramic insulator and the inner circumferential surface of the axial hole of the ceramic insulator, and the thermal etching occurs. Further, the thermal etching causes the dissolution of the grain boundary of crystal structure of the ceramic insulator, and results in the concentration of the channeling with this dissolved area being the starting point. The tendency of the depths of the samples 1~3 is caused by this mechanism.

Here, in the sample 1 having the smallest diameter difference X (diameter difference X: 0.001 mm), the depth of the most deeply cut portion by the channeling is less than 0.3 mm that is associated with the occurrence of the block chip, as mentioned above. However, when focusing attention on a change of the channeling depths of the samples 3, 2 and that of the samples 2, 1, it was found that a degree of increase of the channeling depth of the case where the diameter difference X is changed from 0.004 mm to 0.001 mm (i.e. the sample is changed from 2 to 1) is larger than that of the case where the diameter difference X is changed from 0.009 mm to 0.004 mm (i.e. the sample is changed from 3 to 2). Therefore, if the diameter difference X is less than 0.004 mm, the channeling depth tends to increase. Consequently, when the diameter difference X is greater than or equal to 0.004 mm, certainty of the prevention of the concentration of the channeling becomes high, the diameter difference X 0.004 mm or more is preferable.

EXPERIMENT 2

Next, evaluation concerning the content of the oxide as the material in the ceramic insulator was carried out. In this evaluation experiment, thirteen types of material powder were prepared by blending $SiO_2$ powder, CaO powder, MgO powder, $B_2O_3$ powder and powder of oxide Z with $Al_2O_3$ powder after measuring each mass at mass ratios shown in Table 2. And by a known method, in the same manner as the experiment 1, a plurality of samples of the ceramic insulator used for the one-polar semi-creeping spark plug were made using the thirteen types of material powder. As can be seen in Table 2, oxide Z is an oxide that is mixed with $TiO_2$, $Fe_2O_3$ and $ZrO_2$ according to a mass ratio shown in the table. Then, in the same manner as the experiment 1, the three-dimensional shape of the recess was determined through the CT scan, and samples of the ceramic insulator whose diameter difference X, as the size of the recess, is 0.03 mm were extracted for the each sample, and numbered from 21 to 33 in accordance with composition of the each sample.

After completing the one-polar semi-creeping spark plugs using these prepared ceramic insulator samples 21~33, the each spark plug was installed in the same test engine as the experiment 1, and the same drive test was carried out. Further, through the CT scan, a depth of a most deeply cut portion among the portions on the top end surface of the ceramic insulator, which were cut by the channeling, was measured for the each sample.

Furthermore, using the above thirteen types of material powder, disc-shaped test pieces; diameter ϕ: 25 mm, thickness: 0.65 mm, were made by the press-molding (pressure: 100 MPa) and sintering under the same sintering condition as the ceramic insulator. The same numbers as the ceramic insulator samples were given to these test pieces in accordance with composition of the each test piece. For performing a withstand voltage test, the each test piece was sandwiched between a pair of electrodes, and fixed through an alumina cylinder and a sealing glass. In the withstand voltage test, a high voltage was applied to the each test piece under a 700 ° C. heat condition via a heater, and a withstand voltage at a time when insulation penetration occurs was measured. This result is shown in Table 2.

As shown in Table 2, it was verified that as the content of oxide Z increases, the depth of the most deeply cut portion due to the channeling becomes shallower. In the samples 21~24, each oxide Z content of which is less than 0.02 mass %, the depth of the portion cut by the channeling was beyond 0.30 mm. From this result, it was found that, to prevent the occurrence of the block chip, the content of the oxide Z, i.e. the content of at least one or more oxides selected from $TiO_2$, $Fe_2O_3$, $ZrO_2$ should be 0.02 mass % or more in total.

On the other hand, it was verified that as the content of oxide Z increases, the withstand voltage of the ceramic insulator (the withstand voltage of the same composition test piece) becomes lower. In the samples 32, 33, each oxide Z content of which is greater than 0.30 mass %, the withstand voltage was below 25 kV/mm. In general, in the test piece made under the above condition, if the withstand voltage is below 25 kV/mm, there is a risk that the penetration fracture will occur in the ceramic insulator having the same composition as that test piece. In view of this risk, it was found that the content of the oxide Z, i.e. the content of at least one or more oxides selected from $TiO_2$, $Fe_2O_3$, $ZrO_2$ should be 0.30 mass % or less in total.

EXPERIMENT 3

Next, evaluation concerning the content of $B_2O_3$ as the material in the ceramic insulator was carried out. In this evaluation experiment as well, in the same manner as the experiment 2, three types of material powder were prepared by blending $SiO_2$ powder, CaO powder, MgO powder, $B_2O_3$ powder and powder of oxide Z with $Al_2O_3$ powder after measuring each mass at mass ratios shown in Table 3. Then a plurality of samples of the ceramic insulator used for the one-polar semi-creeping spark plug were made using the three types of material powder, and numbered from 41 to 43. Further, these corresponding test pieces were made, and the same evaluation experiment as the experiment 2 was carried out. This result is shown in Table 3. In Table 3, as a comparison sample, the result of the sample 29, got in the experiment 2, is also shown.

TABLE 2

| | | | | | | Z [mass %] | | | | Deepest | |
|---|---|---|---|---|---|---|---|---|---|---|---|
| Sample | $Al_2O_3$ [mass %] | $SiO_2$ [mass %] | CaO [mass %] | MgO [mass %] | $B_2O_3$ [mass %] | $TiO_2$ [mass %] | $Fe_2O_3$ [mass %] | $ZrO_2$ [mass %] | Z [mass %] | Channeling Depth [mm] | Withstand Voltage [kV/mm] |
| 21 | 95.26 | 2.52 | 2.00 | 0.10 | 0.12 | 0 | 0 | 0 | 0 | 0.34 | 32 |
| 22 | 95.24 | | | | | 0.01 | | | 0.01 | 0.31 | |
| 23 | | | | | | 0 | 0.01 | | | | |
| 24 | | | | | | | 0 | 0.01 | | 0.32 | |
| 25 | 95.22 | | | | | 0.01 | 0.01 | 0 | 0.02 | 0.25 | |
| 26 | | | | | | | 0 | 0.01 | | 0.26 | |
| 27 | | | | | | 0 | 0.02 | 0 | | 0.25 | |
| 28 | 95.16 | | | | | 0.01 | 0.04 | | 0.05 | 0.23 | 31 |
| 29 | 94.98 | | | | | 0.05 | 0.09 | | 0.14 | 0.21 | 30 |
| 30 | 94.88 | | | | | 0.07 | 0.10 | 0.02 | 0.19 | 0.19 | 29 |
| 31 | 94.66 | | | | | 0.12 | 0.15 | 0.03 | 0.30 | 0.16 | 26 |
| 32 | 94.38 | | | | | 0.17 | 0.21 | 0.06 | 0.44 | 0.15 | 23 |
| 33 | 94.08 | | | | | 0.22 | 0.29 | 0.08 | 0.59 | 0.14 | 20 |

TABLE 3

| Sample | $Al_2O_3$ [mass %] | $SiO_2$ [mass %] | CaO [mass %] | MgO [mass %] | $B_2O_3$ [mass %] | Z [mass %] $TiO_2$ [mass %] | $Fe_2O_3$ [mass %] | $ZrO_2$ [mass %] | Z [mass %] | Deepest Channeling Depth [mm] | Withstand Voltage [kV/mm] |
|---|---|---|---|---|---|---|---|---|---|---|---|
| 41 | 95.09 | 2.52 | 2.00 | 0.10 | 0.01 | 0.05 | 0.09 | 0 | 0.14 | 0.16 | 31 |
| 29 | 94.98 | | | | 0.12 | | | | | 0.21 | 30 |
| 42 | 94.96 | | | | 0.14 | | | | | 0.24 | 29 |
| 43 | 94.91 | | | | 0.19 | | | | | 0.32 | 27 |

As shown in Table 3, it was verified that as the content of $B_2O_3$ increases, the depth of the most deeply cut portion due to the channeling becomes deeper, and the withstand voltage of the ceramic insulator (the withstand voltage of the same composition test piece) becomes lower. In the sample 43 having the highest $B_2O_3$ content (content of $B_2O_3$: 0.19 mass %), although the withstand voltage was over 25 kV/mm, the depth of the portion cut by the channeling was 0.32 mm. From this result, regarding the content of $B_2O_3$, it was found that $B_2O_3$ content should be 0.14 mass % or less.

EXPERIMENT 4

Next, evaluation concerning a withstand voltage characteristic against the thickness T of the ceramic insulator was carried out. Using the material of the ceramic insulator formed from the same composition as the sample 29 (see Table 2) of the experiment 2, in the same manner as the experiment 2, four different disc-shaped test pieces (sample numbers 51~54); diameter ϕ: 25 mm, thickness T: 0.50~0.92 mm, were made by the press-molding (pressure: 100 MPa) and sintering under the same sintering condition as the ceramic insulator. Then the each test piece was sandwiched between a pair of electrodes, and fixed through an alumina cylinder and a sealing glass. Under a 700 ° C. heat condition, 35 kV high voltage was applied to the each test piece, and evaluation whether the insulation penetration occurs was carried out. This result is shown in Table 4.

TABLE 4

| Sample | Ceramic Insulator Thickness T [mm] | Occurrence of Insulation Penetration |
|---|---|---|
| 51 | 0.50 | Yes |
| 52 | 0.65 | Yes |
| 53 | 0.80 | No |
| 54 | 0.92 | No |

As shown in Table 4, while the insulation penetration occurred in the samples 51, 52 of the thickness T 0.65 mm or less, no insulation penetration occurred in the samples 53, 54 of the thickness T 0.80 mm or more. From this result, in order for the ceramic insulator to have a sufficient withstand voltage, it was found that the thickness T of the ceramic insulator should be 0.80 mm or more.

As described above, the present invention has the following effects.

In the spark plug of the present invention, the diameter difference X of the diameters of the first imaginary circle which passes through the portion of the recess whose radial distance from the axis is a maximum and the second imaginary circle which passes through the portion of the recess whose radial distance from the axis is a minimum, from among the recesses formed in the first edge portion of the ceramic insulator, is set to be 0.08 mm or less. In a case where the recess whose diameter difference X is greater than 0.08 mm is formed, upon the occurrence of the surface discharge that appears along the top end surface of the ceramic insulator, the paths of the sparks are apt to converge or gather in a path passing through the recess. Because of this, there is a risk that the surface of the ceramic insulator will be cut or shaved off (or chipped off) due to the sparks, namely that a so-called channeling will intensively occur at a certain point. Furthermore, if the certain point on the surface of the ceramic insulator is deeply cut by the concentration of this channeling, for example, there is a possibility that the block chip will appear along the grain boundary of crystal structure of the ceramic insulator with the certain point being the starting point. When setting the diameter difference X to 0.08 mm or less, it is possible to suppress the convergence of the path of the spark on the certain point upon the occurrence of the surface discharge, and the occurrence of the concentration of the channeling can be suppressed.

In the present invention, the diameter difference X is set to be greater than or equal to 0.004 mm. If there is a portion having the diameter difference X that is less than 0.004 mm in the recess, the size of the recess in this portion becomes extremely small, and the edge of the edge portion remains as it is. Heat tends to be accumulated in such edge. Further, when a temperature of such edge becomes locally high, thermal etching occurs at this high-temperature area. This might cause dissolution of the grain boundary of crystal structure of the ceramic insulator, and result in the concentration of the channeling with this dissolved area being the starting point. When the diameter difference X is 0.004 mm or greater, the occurrence of the concentration of the channeling, caused by the heat accumulation, can be effectively suppressed.

In the present invention, even though the first edge portion is chamfered, the diameter difference Y of the diameters of the third imaginary circle which passes through the portion of the recess whose radial distance from the axis is a maximum and the fourth imaginary circle which passes through the portion of the recess whose radial distance from the axis is a minimum, from among the recesses formed in the second edge portion of the ceramic insulator, is set to be 0.08 mm or less. In a case where the recess whose diameter difference Y is greater than 0.08 mm is formed, upon the occurrence of the surface discharge that appears along the top end surface of the ceramic insulator, the paths of the sparks are apt to converge or gather in a path passing through the recess. Because of this, there is a risk that the surface of the ceramic insulator will be cut or shaved off (or chipped off) due to the sparks, namely that a so-called channeling will intensively occur at a certain point. Furthermore, if the certain point on the surface of the ceramic insulator is deeply cut by the concentration of this channeling, for example, there is a possibility that the block chip will appear along the grain boundary of crystal structure of the ceramic insulator with the certain point being the starting point. When setting the diameter difference Y to 0.08 mm or less, it is possible to suppress the convergence of the path of the spark on the certain point upon the occurrence of the surface discharge, and the occurrence of the concentration of the channeling can be suppressed.

In the present invention, the diameter difference Y is set to be greater than or equal to 0.004 mm. If there is a portion having the diameter difference Y that is less than 0.004 mm in the recess, the size of the recess in this portion becomes extremely small, and the edge of the edge portion remains as it is. Heat tends to be accumulated in such edge. Further, when a temperature of such edge becomes locally high, thermal etching occurs at this high-temperature area. This might cause dissolution of the grain boundary of crystal structure of the ceramic insulator, and result in the concentration of the channeling with this dissolved area being the starting point. When the diameter difference Y is 0.004 mm or greater, the occurrence of the concentration of the channeling, caused by the heat accumulation, can be effectively suppressed.

In the present invention, it is desirable that ceramic insulator should contain 0.02~0.30 mass % in total of at least one or more oxides selected from $TiO_2$, $Fe_2O_3$, $ZrO_2$. Since these oxides have conductivity, when mixing a small amount of these oxides as the material of the ceramic insulator into the ceramic insulator, a resistance of surface of the ceramic insulator decreases, and it is conceivable that even if the surface discharge appearing on the surface of the ceramic insulator occurs, this oxide-mixed ceramic insulator has an effect of reducing damage to the ceramic insulators resulting from the sparks. Accordingly, by mixing the small amount of the oxides into the ceramic insulator, the cutting of the surface of the ceramic insulator, caused by the spark discharge, can be suppressed, and the occurrence of the concentration of the channeling can be suppressed. In a case where the content of these oxides is less than 0.02 mass %, the effect of reducing damage to the ceramic insulators resulting from the sparks is not adequately obtained. In addition, this means blending the conductive material with the ceramic insulator, thus brings about a slight decrease or deterioration in a withstand voltage performance of the ceramic insulator. If the content of these oxides is greater than 0.30 mass %, the withstand voltage performance of the ceramic insulator decreases, and there is a risk that the penetration fracture will occur to the ceramic insulator.

In the present invention, to secure the withstand voltage performance of the ceramic insulator, which is decreased by the blending of the oxides, it is desirable that the thickness T of the top end portion of the ceramic insulator should be 0.8 mm or greater. With this thickness, the withstand voltage performance of the ceramic insulator can be secured.

In the present invention, it is desirable that the content of $B_2O_3$ be 0.14 mass % or less. Since the $B_2O_3$ lowers the melting point of the alumina-based ceramic insulator, the less $B_2O_3$ content the better for the prevention of the dissolution (wear) of the grain boundary of crystal structure of the ceramic insulator. With this $B_2O_3$ content, the effects of suppressing the occurrence of the channeling and/or the block chip along the grain boundary of crystal structure of the ceramic insulator can be obtained.

The entire contents of Japanese Patent Application No. 2008-154659 filed on Jun. 12, 2008 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A spark plug generating a spark discharge including a surface discharge, comprising:

a center electrode;

a ceramic insulator having an axial hole that is formed in an axial center of the ceramic insulator in an axis direction to support the center electrode therein with a top end portion of the center electrode protruding from a top end surface of the ceramic insulator, the ceramic insulator provided with recesses at a first edge portion between the top end surface of the ceramic insulator and an inner circumferential surface of the axial hole;

a metal shell which has a plug attachment portion provided with screw thread for installation to an internal combustion engine and holds the ceramic insulator with an outer circumference of the ceramic insulator covered with the metal shell; and a ground electrode, one end portion of which is fixedly connected with the metal shell, and the other end portion of which is located apart from an outer circumferential surface of the top end portion of the center electrode for defining a spark discharge gap therebetween, the spark discharge including the surface discharge that appears along the top end surface of the ceramic insulator occurring in the spark discharge gap, and when defining a first imaginary circle with the axis being a center as a circle that passes through a portion of the recess whose radial distance from the axis is a maximum and defining a second imaginary circle with the axis being the center as a circle that passes through a portion of the recess whose radial distance from the axis is a minimum, from among the recesses, and further expressing a difference of diameters of the first and second imaginary circles as a diameter difference X, the diameter difference X being less than or equal to 0.08 mm, and greater than or equal to 0.004 mm.

2. The spark plug as claimed in claim 1, wherein:

the ceramic insulator contains 0.02-0.30 mass % in total of at least one or more oxides selected from $TiO_2$, $Fe_2O_3$, $ZrO_2$.

3. The spark plug as claimed in claim 2, wherein:

when expressing a thickness in a radial direction, of a top end portion of the ceramic insulator as a thickness T, the thickness T is greater than or equal to 0.8 mm.

4. The spark plug as claimed in claim 1, wherein:

the ceramic insulator contains $B_2O_3$, and a content of $B_2O_3$ is 0.14 mass % or less.

5. The spark plug as claimed in claim 1, wherein:

a nominal diameter of the plug attachment portion is M12 or less.

6. The spark plug as claimed in claim 1, wherein:

a nominal diameter of the plug attachment portion is M10 or less.

7. The spark plug as claimed in claim 1, wherein:

a length in the axis direction between two screw thread formation starting positions provided on the plug attachment portion is 25 mm or more.

8. A spark plug generating a spark discharge including a surface discharge, comprising:

a center electrode;

a ceramic insulator having an axial hole that is formed in an axial center of the ceramic insulator in an axis direction to support the center electrode therein with a top end portion of the center electrode protruding from a top end surface of the ceramic insulator, the ceramic insulator having a chamfer surface that is formed by chamfering a first edge portion between the top end surface of the ceramic insulator and an inner circumferential surface of the axial hole and provided with recesses at a second edge portion between the chamfer surface and the top end surface;

a metal shell which has a plug attachment portion provided with screw thread for installation to an internal combustion engine and holds the ceramic insulator with an outer circumference of the ceramic insulator covered with the metal shell; and a ground electrode, one end portion of which is fixedly connected with the metal shell, and the other end portion of which is located apart from an outer circumferential surface of the top end portion of the center electrode for defining a spark discharge gap therebetween, the spark discharge including the surface discharge that appears along the top end surface of the ceramic insulator occurring in the spark discharge gap, and when defining a first imaginary circle with the axis being a center as a circle that passes through a portion of the recess whose radial distance from the axis is a maximum and defining a second imaginary circle with the axis being the center as a circle that passes through a portion of the recess whose radial distance from the axis is a minimum, from among the recesses, and further expressing a difference of diameters of the first and second imaginary circles as a diameter difference Y, the diameter difference Y being less than or equal to 0.08 mm, and greater than or equal to 0.004 mm.

9. The spark plug as claimed in claim 8, wherein:

the ceramic insulator contains 0.02-0.30 mass % in total of at least one or more oxides selected from $TiO_2$, $Fe_2O_3$, $ZrO_2$.

10. The spark plug as claimed in claim 9, wherein:

when expressing a thickness in a radial direction, of a top end portion of the ceramic insulator as a thickness T, the thickness T is greater than or equal to 0.8 mm.

11. The spark plug as claimed in claim 8, wherein:

the ceramic insulator contains $B_2O_3$, and a content of $B_2O_3$ is 0.14 mass % or less.

12. The spark plug as claimed in claim 8, wherein:

a nominal diameter of the plug attachment portion is M12 or less.

13. The spark plug as claimed in claim 8, wherein:

a nominal diameter of the plug attachment portion is M10 or less.

14. The spark plug as claimed in claim 8, wherein:

a length in the axis direction between two screw thread formation starting positions provided on the plug attachment portion is 25 mm or more.

* * * * *